United States Patent [19]

Karlovits

[11] Patent Number: 4,923,494

[45] Date of Patent: May 8, 1990

[54] MAKING ICE IN A REFRIGERATOR

[75] Inventor: Frank K. Karlovits, Arlington Hts., Ill.

[73] Assignee: Eaton Corporation, Cleveland, Ohio

[21] Appl. No.: 258,308

[22] Filed: Oct. 17, 1988

[51] Int. Cl.[5] ..... F25C 5/08

[52] U.S. Cl. ..... 62/73; 62/351; 62/353

[58] Field of Search ..... 62/71, 73, 351, 353

[56] References Cited

U.S. PATENT DOCUMENTS

| | | | |
|---|---|---|---|
| Re. 24,628 | 4/1959 | Heath | 62/353 X |
| 2,833,123 | 5/1958 | Kennedy et al. | 62/353 X |
| 3,064,442 | 11/1962 | Bougie et al. | 62/353 X |

*Primary Examiner*—William E. Tapolcai
*Attorney, Agent, or Firm*—R. A. Johnston

[57] ABSTRACT

A stationary tray melt-out ice maker for forming individual ice sections in a refrigerator. The tray has a plurality of crescent-shaped ice molding cavities and one arm of a rotatable harvesting comb is immersed in each ice molding cavity for freezing of ice with the arm embedded therein. Upon heating of the tray, the harvest comb is rotated such that the ice embedded arm sweeps the individual crescent-shaped ice from the molding cavities. Continued rotation of the comb causes the ice to contact stationary strippers which cause fracturing and stripping of the crescent-shaped ice from the arm and harvesting of two quarter round sections of ice from each crescent-shaped ice formation.

8 Claims, 4 Drawing Sheets

MAKING ICE IN A REFRIGERATOR

BACKGROUND OF THE INVENTION

The present invention relates to ice makers for household refrigerators of the type having a compartmentalized stationary tray which is filled with a controlled amount of water and ice is permitted to form in the tray compartments. Ice makers of this type typically employ an electrically operated water fill valve which is controlled to fill the tray when the frozen ice has been removed or harvested from the tray.

In refrigerator ice makers of the type where the ice forming tray is stationary rather than rotated or twisted, it has been found necessary to apply a controlled amount of heat to the tray after ice formation in order to cause a slight amount of melting at the ice-tray interface which serves to facilitate mechanical movement of the ice for removal from the individual tray compartments. Heretofore, the ice formed has exhibited a crescent-shape which has permitted the arms or tines of a rotating comb to sweep the ice from each compartment when the interface between the ice and the tray had melted.

Cresent shaped ice has the disadvantage that, when utilized in a round beverage drinking glass or container, the curved surface of the ice tends to conform to and seal along the sidewall of the circular glass when the user attempts to drink from the glass having several of the crescent-shaped ice chunks received therein. This sealing or blockage along the side wall causes the beverage to be displaced about the sides of the ice and renders drinking from the glass difficult and often results in spillage onto the user. The problem has become sufficiently acute that certain users have purchased polygonally shaped drinking glasses rather than glasses having a circular cross section in order to prevent the crescent shaped ice from aligning with the sidewall of the glass and causing spillage. In order to eliminate the necessity of especially shaped drinking glasses for use with crescent-shaped ice, it has been desired to provide a way or means of making ice from compartmentalized trays having a curved bottom providing crescent ice formation and to permit rotary sweeping of the ice therefrom, and yet provide ice that did not conform to the sidewall of the drinking glass so as to cause blockage and spillage onto the user.

SUMMARY OF THE INVENTION

The present invention provides an ice maker for a household refrigerator having a stationary tray provided with individual ice compartments each having a curved or circular bottom enabling ice formation and rotary sweeping of the compartments for ice harvesting. The ice maker of the present invention employs means for heating the tray sufficient to create melting at the innerface of the ice and the tray bottom to enable an ice harvesting means in the form of a comb to be rotated and thereby sweep the ice from each compartment.

The harvesting means or comb is initially positioned with a tine or arm thereof disposed in the water fill in each compartment such that ice formed therein has the tine embedded therein and secured thereto. At harvest, the bottom of the tray is heated sufficiently to release the adhesion between the ice and the tray. The comb is then rotated to sweep the ice formed over the tine out of the individual ice forming compartments. As the crescent-shaped ice is rotated by the embedded tine or arm, stationary arm members or tines, disposed to contact the upper surface of the rotating ice, are operative to cause the ice to be fractured and stripped from the comb as quarter-round sections or halves of the frozen crescent-shape. A backup tine or arm is spaced from the embedded tine a sufficient amount so as to not be emersed in the water fill, but to prevent the fractured and stripped ice from falling back into the tray. Continued rotation of the comb ejects the fractured and stripped half-crescent shapes into a holding bin.

The present invention thus enables ice to be formed in a refrigerator initially in a crescent shape with a tine or paddle embedded therein. At harvest the tray is heated to release the ice and a rotating comb conveniently sweeps the ice from the tray; and, the crescent shapes are fractured and stripped from the embedded tine so as to form half-crescent or quarter round shapes for the harvested ice. The half-crescent or quarter round ice shape eliminates the problem of ice conforming to the circular side of a glass and creating blockage and flow therearound for spillage onto the user, when the ice is immersed in individual beverages.

The present invention provides a unique and novel way of harvesting crescent-shaped ice in a refrigerator into separate pieces having a quarter round configuration and yet employs the simple technique of freezing ice in a crescent-shaped compartment and upon heated release of the ice rotating a comb to harvest the ice from the compartment.

The fracture of the crescent ice into half crescent or quarter-round sections is facilitated by the position of the embedded arm or tine of the comb.

DETAILED DESCRIPTION

Figure 1:
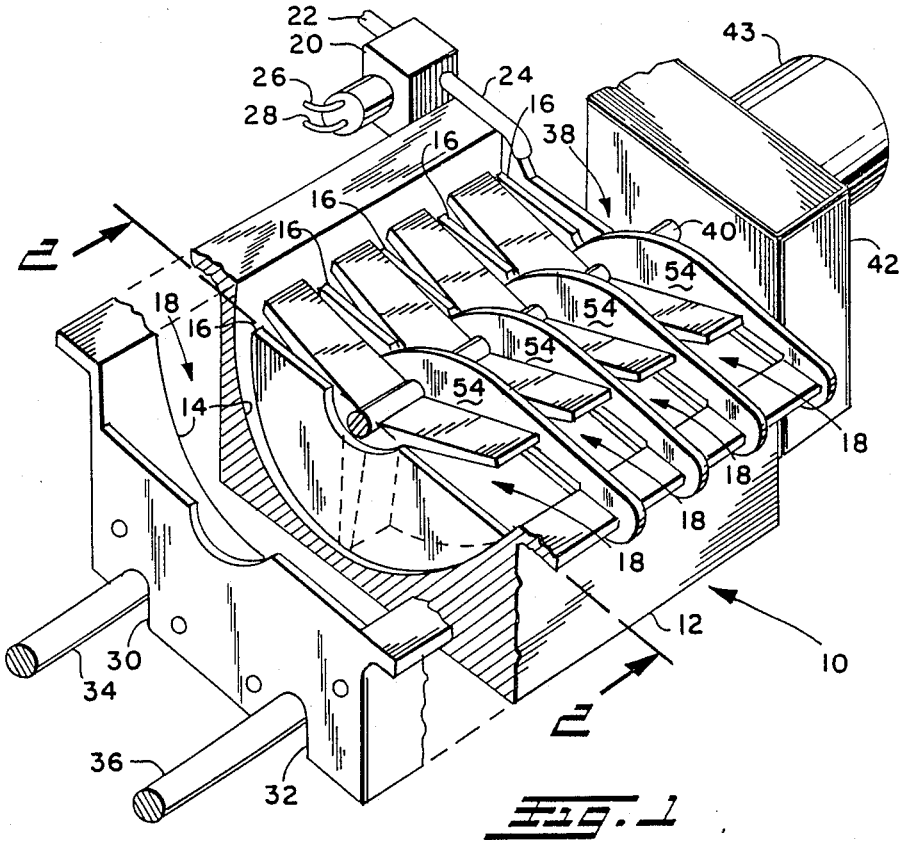
FIG. 1 is a somewhat perspective view of the ice maker assembly of the present invention.

Referring now to FIG. 1, the ice maker assembly as indicated generally by reference numeral 10 has an ice tray 12 formed of a suitable thermally conductive material as for example, aluminum. The tray 12 has the ice forming cavity thereof formed with a curved preferably constant radius bottom 14. The cavity is partitioned into individual ice forming compartments by a plurality of integrally formed partitions or walls 16 spaced to form a plurality of crescent-shaped molding cavities indicated generally at 18.

The tray cavities 18 are filled by a suitable electrically actuated water fill valve 20 which is adapted for connection through tube 22 to a household water line and discharges through tube 24 upon electrical energization from a suitable programmer/timer (not shown) connected to electrical leads 26,28.

The tray 12 has a pair of spaced channels 30,32 formed longitudinally in the undersurface thereof and each of the grooves has respectively one leg of an electrical heat resistance heating rod 34,36, having a generally U shaped configuration received therein and which is adapted for connection to the electrical programmer/timer (not shown). The heating rod 34,36 operative upon electrical energization for a controlled interval of time to provide a slight amount of heating of the curved bottom 14 of the cavity to create localized melting at the ice/tray interface.

Figure 2:
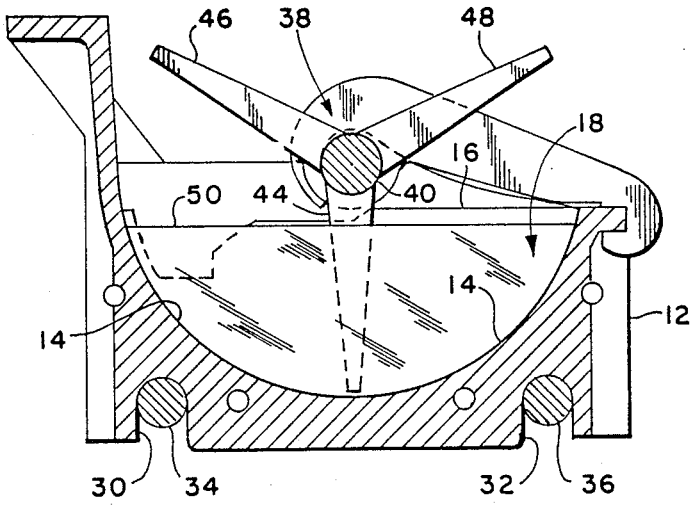
FIG. 2 is a section view taken along section indicating lines 2—2 of FIG. 1.

Referring to FIGS. 1 and 2, a harvesting means indicated generally at 38 is rotatably mounted with respect to the tray 12 and the harvesting means 38 includes a shaft 40 journaled for rotation about an axis parallel to the length of the tray and disposed closely spaced above the partition 16. Shaft 40 is connected to a speed reducing drive 42 powered by motor 43, the operation of which is controlled by an electrical programmer/timer (not shown). Shaft 40 has attached thereto a plurality of axially spaced, preferably tridentine paddles with the blades thereof disposed parallel to the shaft 40 and extending radially outwardly therefrom in preferably circumferentially equally spaced arrangement to collectively form three arcuately spaced combs when viewed en masse. Each of the paddles has an immersion tine or arm 44 which extends from the shaft to a distance closely spaced adjacent the curved bottom 14 of each of the compartments 18. The immersion arm 44 of one of the paddles is shown in its immersed position extending vertically downwardly from shaft 40 in FIG. 2 to divide the cavity 18 about a plane of symmetry which includes the axis of shaft 40. The remaining pair of tines or arms 46,48 extend upwardly from the shaft 40 in a direction opposite the tray compartment 18.

Figure 3:
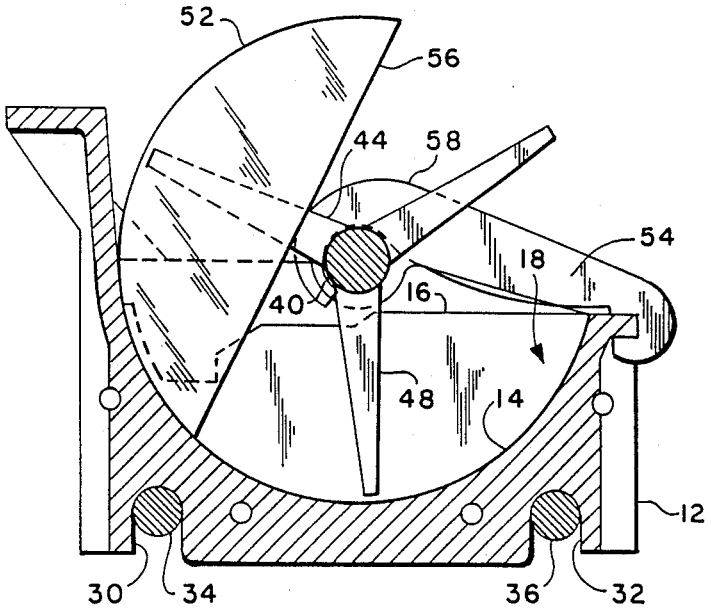
FIG. 3 is a view similar to FIG. 2 with the ice in the first stage of harvest.

With reference to FIGS. 1 through 3, a plurality of stationary strippers, 54 are provided with one disposed between each of the paddles on shaft 40 and the strippers 54 are aligned with the partition 16 to form a stationary comb. Each of the stationary strippers 54 has the upper surface thereof curved to describe a spiral of increasing radius proceeding clockwise about the axis of shaft 40.

With the immersion arm 44 positioned as shown in FIG. 2, the valve 20 is electrically energized and water flows into the compartments 18 of the tray 12 until the desired water level indicated at 50 is achieved. The valve is de-energized to shut off water flow and the water fill in each of the compartments 18 is permitted to freeze about the respective immersion arm 44 extending downwardly therein and forms crescent-shaped ice in the compartment 18 having upper level surface 56.

Upon determination by any suitable means, such as a temperature sensor (not shown), that the water in the compartments 18 has frozen, the heater rod 34,36 is electrically energized for a controlled period of time to cause heating of the tray 12 to a temperature slightly above freezing such that melting occurs at the interface of the ice and tray along the curved bottom 14. When the melting has occured, the motor drive 43,42 having been previously energized but in a state of stall by the programmer/timer (not shown) begins to rotate shaft to sweep the ice indicated in solid outline and by reference numeral 52 in FIG. 3.

With reference to FIG. 3, continued rotation of the crescent ice 52 from the position shown in FIG. 3 causes the ice surface 56 to make contact with the curved surface 58 of the stripper in FIG. 3. Further rotation of shaft 40 and arm 44 causes the ice to be stripped radially outwardly on the arm 44 and to be fractured into two half-crescent or quarter round sections 60,62 as shown in FIG. 4.

Figure 4:
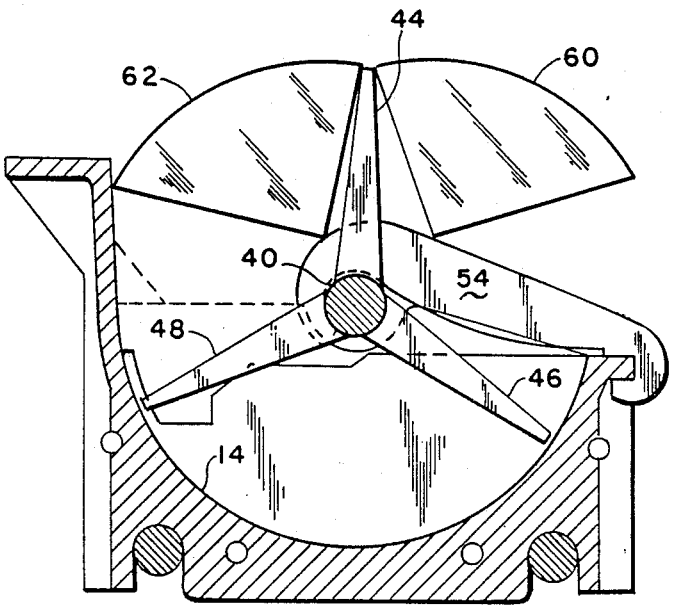
FIG. 4 is a view similar to FIG. 2 illustrating the ice at the beginning of fracture and stripping.
Figure 5:
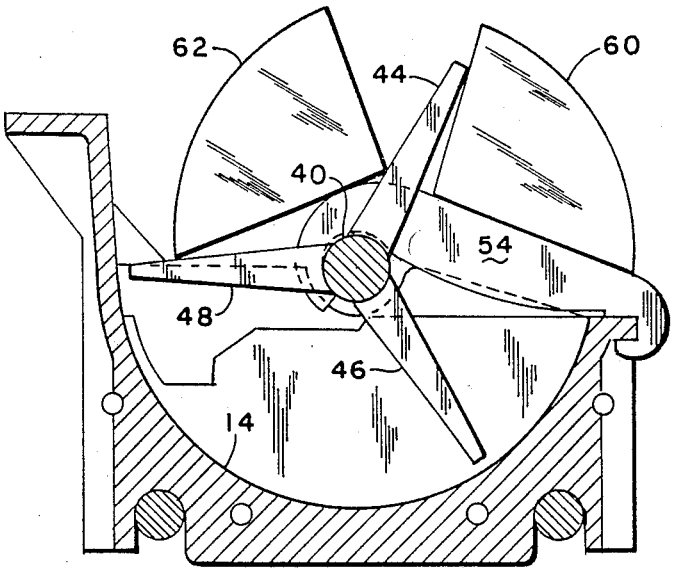
FIG. 5 is a view similar to FIG. 2 illustrating the harvested ice immediately after separation.

Referring to FIG. 5, the shaft 40 is shown in a position rotated approximately 30 degrees clockwise from that illustrated in FIG. 4 wherein the quarter round section of ice 60 has begun to slide down the stationary strippers 54; and, the remaining quarter round section 62 has dropped onto the catcher arm 48.

Figure 6:
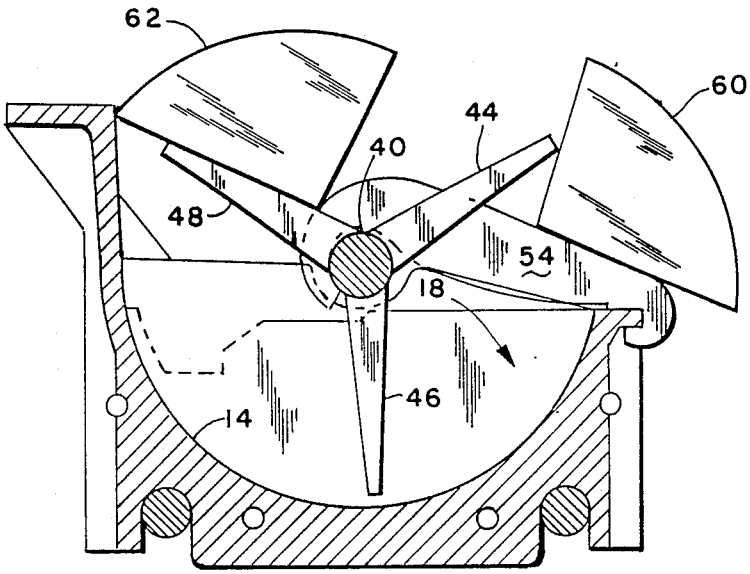
FIG. 6 is a view similar to FIG. 2 illustrating the separated ice supported by the catcher tine and at the beginning of ejection.

Referring to FIG. 6, the shaft 40 has been rotated clockwise an additional 30 degrees from the position of FIG. 5; and, the arm 44 is shown as pushing the quarter round ice section 60 over the edge of the stationary strippers 54 and the catcher arm 48 has lifted quarter round section 62 upwardly for movement onto the stationary strippers 54.

Figure 7:
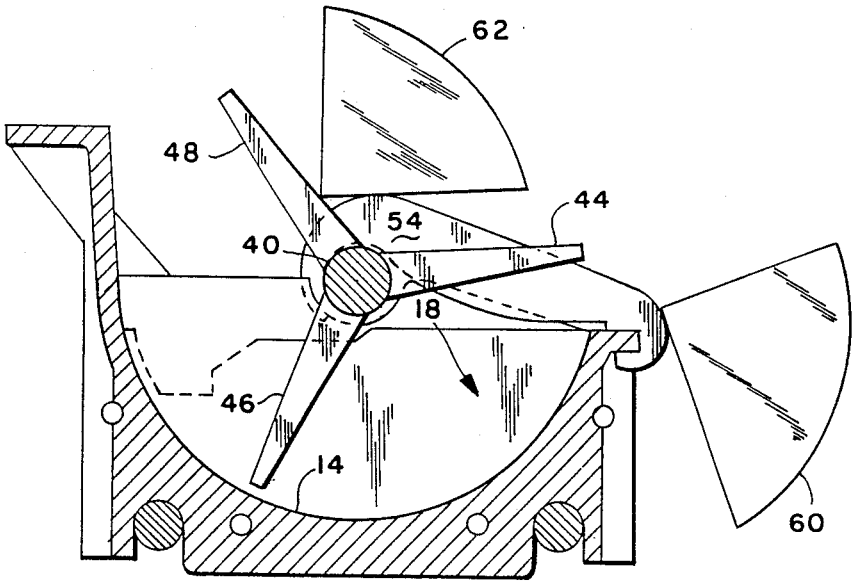
FIG. 7 is a view similar to FIG. 2 showing the separated ice completing the ejection.

Referring to FIG. 7, the shaft 40 is illustrated in a position rotated an additional 30 degrees from the position shown in FIG. 6, and the arm 44 has pushed the quarter round ice section 60 over the edge of stationary strippers 54 for dropping into an ice bin (not shown). Arm 48 is shown as having lifted the remaining quarter round ice section 62 over the edge of stationary strippers 54 to begin pushing the section 62 rightward for ejection into the ice bin in a manner similar to that performed for the quarter round section 60. When the arm 48 has been rotated clockwise a sufficient amount to fully eject the remaining quarter round section 62 into a storage bin, the harvest cycle is thus complete. Shaft 40 is rotated until arm 44 is again disposed vertically downward into tray cavity 18; and, the tray 12 may again be filled with water for freezing another batch of ice.

The present invention thus provides a unique stationary tray melt-out type ice maker for use in refrigerators wherein ice is formed in initially crescent-shaped sections in the tray and one arm of a rotating comb is immersed and frozen embedded into the crescent-shaped ice. At harvest, heat is applied to the tray to loosen the ice/tray interface and the arm of the comb is rotated to sweep the cresent ice from the tray. Continued rotation of the cresent ice formed over the arm causes the ice to make contact with stationary strippers which fracture the crescent ice about the embedded arm into two-quarter round sections and strip the ice from the embedded arm. Continued rotation of the comb ejects the ice into a bin. The present invention thus provides a way of freezing crescent-shaped ice conveniently in a tray and sweeping the ice at harvest from the tray by a rotating comb. The present invention, however, breaks the ice into two quarter round sections to provide a unique and more conveniently usable ice configuration particularly for use in icing cold beverages in drinking glasses and cups.

Although the present invention has hereinabove been described with respect to the illustrated embodiments, it will be understood that the invention is limited only by the following claims.

I claim:

1. An icemaker for use in a refrigerated compartment capable of forming in a mold and harvesting some ice comprising:

(a) tray means defining a plurality of curved-bottom compartments;

(b) electrically operated valve means operable upon connection to a source of water and electrical energization to fill said tray compartments for ice making;

(c) movable harvesting means disposed adjacent said tray means, said harvesting means including a partitioning member extending into each compartment substantially to the said curved bottom, each of said partitioning members being frozen in ice formed in the respective compartment;

(d) heater means operable to heat said tray means for facilitating removal of ice formed in said tray means;

(e) actuator means operable to rotate said harvesting means to cause each of said partitioning members to sweep the respective curved ice frozen thereabout from said tray means; and, (f) comb means disposed adjacent said tray means in fixed relationship thereto and operable to be contacted by said curved ice form during said rotation of said harvesting means, said comb means operative to strip said curved ice form from said partitioning member and break said curved ice form into a plurality of pieces.

2. The icemaker defined in claim 1, wherein said curved bottom tray compartment has a generally constant radius curvature.

3. The icemaker defined in claim 1, wherein each of said partioning members extends substantially the width of said compartment in the direction transverse to the direction of curvature of said curved bottom.

4. The ice maker defined in claim 1, wherein each of said partitioning members has the portion of maximum transverse width radially intermediate the ends thereof for providing a wedging action when said ice is stripped therefrom.

5. The icemaker defined in claim 1, wherein said harvesting means further comprises a catcher member arcuately spaced from each of said partitioning members, said catcher member extending exteriorly of the waterfill in said tray means and rotatable with said partitioning member for preventing said stripped and divided ice from falling into said tray compartment.

6. A method of moulding and harvesting ice in a refrigerator freezer compartment comprising the steps of:

(a) providing a tray having a plurality curved bottom ice formation compartments;

(b) positioning a paddle in each of said ice compartments;

(c) filling each compartment with water and freezing the water therein about said paddle member to form ice in the shape of said curved bottom;

(d) heating said tray to facilitate ice removal;

(e) rotating each of said paddle members to sweep said ice from said compartment;

(f) providing a stationary comb means to said ice from each of said paddle members and divide each of said ice forms about said paddle into a plurality of pieces.

7. The method defined in claim 6 wherein said step of positioning and dividing includes the step of positioning the paddle in the center of said compartment and dividing the compartment equally.

8. The method defined in claim 6, wherein said steps of stripping and dividing includes the step of and interdigitating the tines of the comb with said paddles.

* * * * *